United States Patent [19]

Sachuk et al.

[11] 4,061,329

[45] Dec. 6, 1977

[54] OFFSET CARD FEED APPARATUS

[75] Inventors: Daniel B. Sachuk, Exton; Robert L. Lane, Broomall, both of Pa.

[73] Assignee: Computer Peripherals, Inc., Rochester, Mich.

[21] Appl. No.: 745,338

[22] Filed: Nov. 26, 1976

[51] Int. Cl.[2] ..... B65H 3/06; B65H 5/06

[52] U.S. Cl. ..... 271/10; 271/118; 271/126; 271/166; 271/225

[58] Field of Search ..... 271/118, 117, 225, 126, 271/165, 166, 160, 110, 10, 37, 38

[56] References Cited

U.S. PATENT DOCUMENTS

| | | | |
|---|---|---|---|
| 1,441,271 | 1/1923 | De Escobales | 271/118 |
| 3,160,411 | 12/1964 | Fiehl | 271/117 X |
| 3,514,098 | 5/1970 | Ostwald | 271/118 X |
| 3,790,162 | 2/1974 | Halbert | 271/118 |
| 3,815,900 | 6/1974 | Schulze | 271/118 |
| 3,933,350 | 1/1976 | Mignand | 271/165 X |

FOREIGN PATENT DOCUMENTS

| | | | |
|---|---|---|---|
| 1,383,770 | 2/1975 | United Kingdom | 271/126 |

*Primary Examiner*—Bruce H. Stoner, Jr.
*Attorney, Agent, or Firm*—J. T. Cavender; Wilbert Hawk, Jr.; Richard W. Lavin

[57] ABSTRACT

Card feeding apparatus for feeding the lowermost card from a stack of cards to an off-set station from which the card is fed to a processing station. A feed roller driven by a drive roller is rotated about the periphery of the drive roller and into engagement with the lowermost card by operation of an actuating member, the feed roller feeding the card to a stationary position in the off-set station. Upon release of the actuating member, the drive roller, acting against the stationary card, rotates the feed roller to a disengaged position, the feed roller holding the card in the stationary position during such return movement.

13 Claims, 3 Drawing Figures

OFFSET CARD FEED APPARATUS

BACKGROUND OF THE INVENTION

The present invention relates to an improved card feeding means and more particularly to an offset feeder mechanism for feeding the lowermost card from a stack of record cards to an offset position and which employs a constantly driven high-friction feed roller mounted for movement into and out of engagement with the lowermost record card by means of a solenoid and linkage arrangement.

A requirement that has to be met in this type of record card movement is to insure that the offset card remains stationary while the feed mechanism retracts for movement to its home position so that the card is in position for a further feed movement. Prior feeding devices of this type have utilized a second feed and pressure roller combination to engage the record card after it has been removed from the stack of supporting the card while the first feed roller is removed from the card. Examples of this type of card feed apparatus may be found in U.S. Pat. Nos. 3,642,271 and 3,693,967. It has been found that this type of construction has required costly and complex drive trains together with critical alignment requirements between the feed rollers which require frequent adjustments.

Accordingly, it is an object of the present invention to provide a novel card feed apparatus which selects and feeds a single record card from a stack of cards to an offset position and holds the cards in such offset position while the feed apparatus returns to its home position. It is a further object of this invention to provide a card feed apparatus which utilizes a single feed roller for feeding a record card from a stack of cards to an offset position with the feed roller holding the card in such offset position while the feed roller returns to its home position. It is another object of this invention to provide a card feed apparatus which will function in the manner set out above which is simple in construction and therefore low in cost. Other objects and advantages, as well as the exact nature of the invention, will be readily apparent to those skilled in the art from the consideration of the following disclosure of the invention.

SUMMARY OF THE INVENTION

In order to carry out the stated objects, there is provided a friction drive roller positioned adjacent the lowermost record card of a stack of cards located in a hopper of a card processing apparatus. The friction roller is engaged by a constantly driven drive roller, the friction drive roller being mounted for movement around the periphery of the driven drive roller while in contact with the driven drive roller. An actuating member is operated to rotate the friction drive roller into engagement with the lowermost card in the hopper driving the card through a metering throat in the hopper to an offset position where the card engages a blocking surface. Upon release of the actuating member, the driven drive roller will walk the friction drive roller back to its home position during which time the friction drive roller is rotating in a direction to keep a friction force on the card which force holds the card against the blocking surface.

DESCRIPTION OF THE PREFERRED EMBODIMENT

Figure 1:
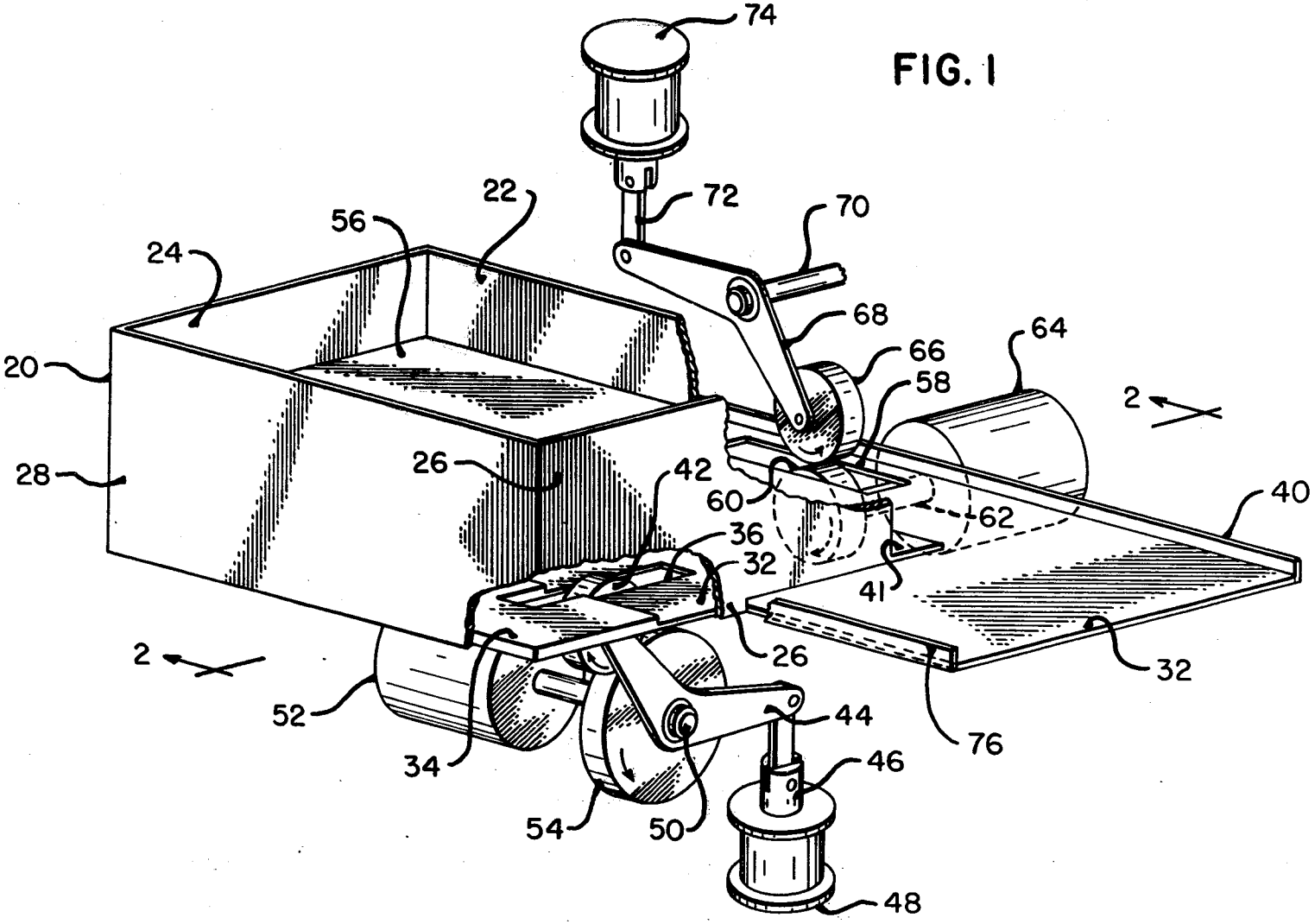
FIG. 1 is a perspective view of the card feeder apparatus constructed according to the invention with portions of the card hopper removed to show details of the friction drive assembly and the off-set drive assembly.
Figure 2:
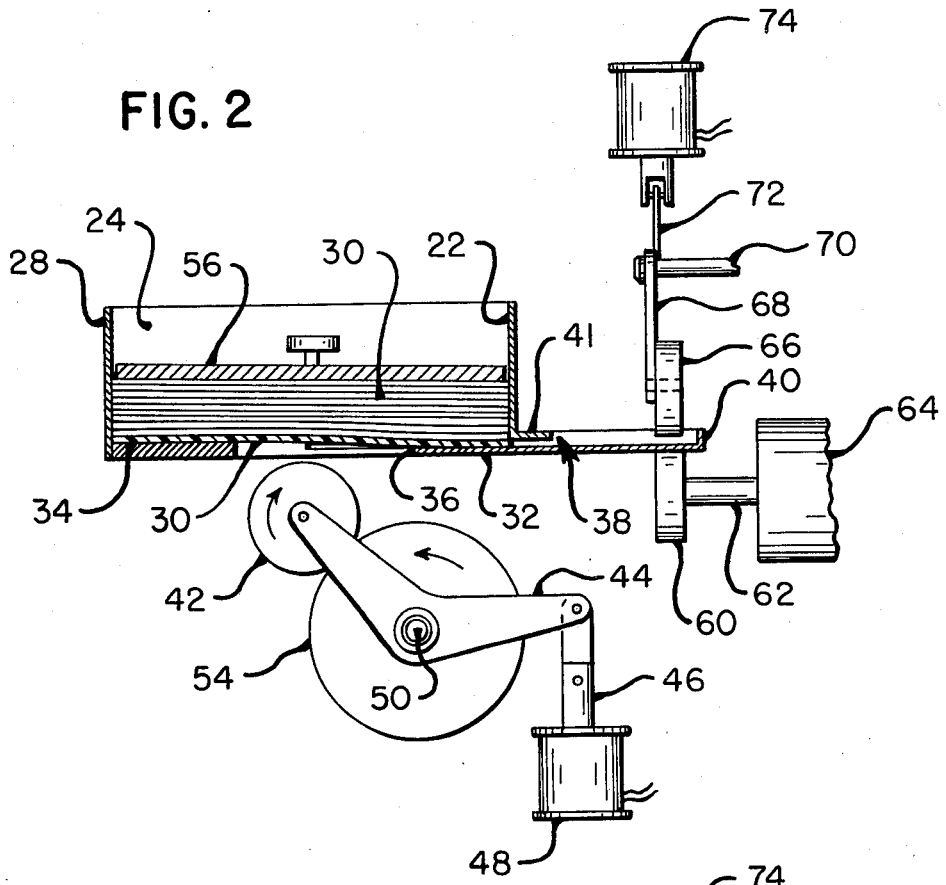
FIG. 2 is a sectional view taken along line 2—2 of FIG. 1 showing the friction drive roller in the home position.
Figure 3:
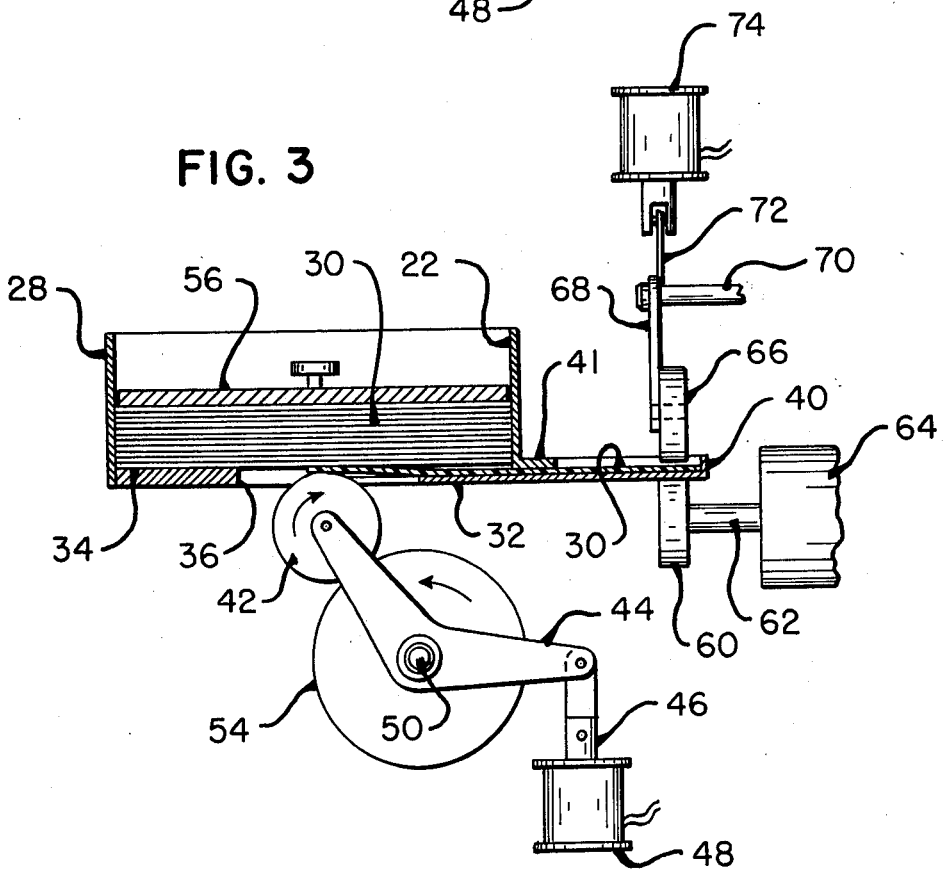
FIG. 3 is the same view as FIG. 2 showing the friction drive roller in an actuated position driving a record card into engagement with the blocking surface.

Referring to FIG. 1 of the drawings, wherein like reference numbers refer to like parts, there is shown a perspective view of a card hopper 20 having a rear 22, sides 24, 26 and front 28 walls forming a compartment into which is placed a stack of record cardds 30 (FIGS. 2 and 3) or the like which are used in modern day data processing systems. For clarity, the lowermost card 30 of the stack is shown in FIGS. 2 and 3 in section. Secured to each of the walls 22–28 inclusive is a bottom wall 32 having a raised edge 34 positioned adjacent the front wall 28. Located in the bottom wall 32 is a rectilinear slot 36 extending lengthwise between the rear 22 and front wall 28 of the hopper 20.

As best seen in FIGS. 2 and 3, a slit or throat 38 is formed between the bottom edge of the rear wall 22 and the bottom wall 32. The throat 38 is made sufficiently wide to accommodate the thickness of one card 30 which is to be moved from the stack but not wide enough to accommodate two such cards. A typical throat width is about 9 mils (0.009 inches), slightly larger than the thickness of a typical tabulating card which is about 7 mils (0.007 inches).

The bottom wall 32 of the hopper extends to the side of the hopper 20 a sufficient distance to form an offset station, the wall 32 terminating in an upright edge 40 which forms a blocking surface for the cards 30 as they are removed from the hopper 20. The rear wall 22 has an L-shaped lower edge 41 which forms the throat 38 with the bottom wall 32 through which the cards 30 are fed as will be described more fully hereinafter.

Mounted adjacent the bottom wall 32 of the hopper 20 is a friction drive assembly comprising a friction drive roller or wheel 42 rotatably mounted on one end of a lever arm 44. The other end of the arm 44 is rotatably secured to one end of the armature 46 of a solenoid 48 mounted within the apparatus. The arm 44 is rotatably secured to one end of the drive shaft 50 of a motor 52 (FIG. 1) for independent rotation about said shaft. Secured to the drive shaft 50 is a drive wheel or roller 54 which, due to the geometry of the arm 44, engages and rotates the friction drive roller 42 upon operation of the motor 52.

As shown more clearly in FIG. 1, the friction drive roller 42 is positioned adjacent the slot 36 for movement through the slot and into engagement with the lowermost record card 30 in the hopper 20 when so actuated. As shown more clearly in FIG. 2, the lowermost card 30 of the stack of cards when positioned within the hopper 20 will have one end resting on the raised edge 34 of the bottom wall 32 which orientates the card in a downward direction wherein the other end of the card is positioned adjacent the throat 38. This arrangement facilitates the separation of the lowermost card from the stack and further positions the edge of the lowermost card 30 adjacent the throat 38 through which it will be moved to the off-set position.

When a feed operation is to occur, the motor 52 is continuously operated to rotate the drive roller 54 in a counter-clockwise direction as indicated by the arrows in FIGS. 2 and 3. Counter-clockwise rotation of the drive roller 54 results in the corresponding clockwise rotation of the friction drive roller 42. Upon the energizing of the solenoid 48, the armature 46 will be moved in a downward direction resulting in the arm 44 being rocked about the shaft 50 in a clockwise direction thus moving the rotating friction drive roller 42 into engagement with the lowermost card 30 in the hopper 20. The weight of the stack of cards 30 provides a frictional force between the lowermost card 30 and the roller 42 allowing the drive roller 42 to drive the lowermost card 30 through the throat 38 and into engagement with the raised edge 40 of the bottom wall 32 (FIG. 3). As such card 30 is driven through the throat 38 by the friction drive roller 42, the rear edge of the card will move off the raised edge 34 of the bottom wall 32 and settle on the bottom wall. The weight of the stack will then move the next card 30 into position with one end located on the raised edge 34 of the bottom wall 32. This construction provides, in addition to facilitating the feeding of the lowermost card 30 from the stack, minimum interference between the card 30 located in the off-set position and the next lowermost card 30 of the stack.

Upon deenergizing of the solenoid 48, the rotation of the drive roller 54 will rotate the frictional drive roller 42 in a counter-clockwise direction about the periphery of the drive roller 54 to its home position (FIG. 1). During this return movement, the card 30 in the off-set position will be held securely against the edge 40 of the bottom wall 32 by the friction force developed between the card 30 and the drive roller 42 due to the constant clockwise rotation of such roller 42 as it revolves counter-clockwise about the drive roller 54 to its home position.

In order to continue to provide the required force on the lowermost card 30 as the stack is depleted, a weight member 56 may be positioned on the stack of cards to allow the last card of the stack to be moved to the off-set position.

As shown more clearly in FIG. 1, located in that portion of the bottom wall 32 which constitutes the off-set position is a slot 58 similar to slot 36 and which extends in a direction normal to such slot 36. Mounted adjacent the lower surface of the wall 32 is a drive roller 60 located within the slot 58 and secured to the shaft 62 of a drive motor 64. Positioned adjacent the top surface of the wall 32 and in registry with the drive roller 60 is a pressure roller 66 rotatably mounted to one end of a lever arm 68 in the same fashion as the friction drive roller 42 is mounted on arm 44. The lever arm 68 is rotatably secured to a shaft 70 mounted within the apparatus adjacent the hopper 20. The other end of the lever arm 68 is rockably secured to one end of the armature 72 of a solenoid 74.

With such construction, after the card 30 has been positioned against the edge 40 of the wall 32 by the friction drive roller 42 and the roller 42 has returned to its home position, the solenoid 74 is energized for retracting its armature 72. This action results in the lever arm 68 rocking the pressure roller 66 into engagement with the card 30 located in the off-set position and moving such card into engagement with the drive roller 60, resulting in the card 30 being driven along the bottom wall 32 in a direction perpendicular to the movement of the card 30 from the hopper 20. This movement positions the card in a processing station for further processing. Movement of the card 30 from the off-set position to the processing station will be guided by the edges 40 and 76 (FIG. 1) of the bottom wall 32, which edges may extend from the off-set position to the processing station. This construction prevents skewing of the card by the drive roller 60 during such movement to the processing station.

While there has been described a form of the invention and its mode of operation, it will be apparent to those skilled in the art that changes may be made in the apparatus described without departing from the spirit and scope of the invention as set forth in the appended claims and that in some cases, certain features of the invention may be used to advantage or modified without corresponding changes in other features, while certain features may be substituted for or eliminated as appreciated by those skilled in the art.

What is claimed is:

1. An apparatus for feeding record cards from a card supply to a stationary position comprising:
   a. drive means operating in a first direction;
   b. feed means positioned adjacent a card in said card supply and engaging said drive means for operation in a second direction opposite to said first direction;
   c. means supporting said feed means for movement into engagement with the card in the card supply when actuated, said feed means operated by said drive means in said second direction during said engaging movement to feed the enlarged card from the card supply to the stationary position;
   d. and actuating means operatively associated with said support means to actuate said support means in said second direction to position the feed means in a card engaged position when enabled, said drive means moving the feed means in said first direction to a card disengaged position upon the disabling of said actuating means wherein said feed means will operate in said second direction while simultaneously being moved in said first direction by said drive means, which movement in said second direction will hold the card in the stationary position during movement of the feed means to the disengaged position.

2. The feeding apparatus of claim 1 further comprising a blocking means in the stationary position which engages and stops the movement of the card in the stationary position, said feed means continuously urging the card against the blocking means during movement of the feed means to the disengaged position by said drive means.

3. The feeding apparatus of claim 2 in which said drive means includes a fixed position drive roller and means for constantly rotating said drive roller in said first direction, said supporting means being mounted for rotational movement about an axis axially aligned with the axis of rotation of said drive roller while supporting said feed means in contact with said drive roller, said supporting means being rotated in said second direction upon operation of said actuating means to revolve the feed means around the periphery of said drive roller in said second direction and into engagement with a card in said card supply whereby the feed means will feed the card into a stationary position against said blocking means.

4. The feeding apparatus of claim 3 in which said feed means comprises a feed roller constantly rotated by said drive roller for movement in second said direction to feed a card in said card supply in a direction to engage the blocking means in the stationary position, said feed roller rotating in said second direction to urge the card against the blocking means when moving along the periphery of said drive roller in said first direction to a disengaged position upon the disabling of said actuating means.

5. The feeding apparatus of claim 1 in which said card supply includes:

a. a hopper for supporting a stack of cards including a supporting surface having a raised portion at one end for supporting the cards in an angular position for engagement with said feed means;

b. means urging the cards in a direction towards the feed means;

c. and an aperture in the hopper adjacent the other end of said supporting surface wherein one end of the lowermost card in the stack of cards is orientated at an angle adjacent the aperture for movement therethrough when engaged by said feed means, said cards being positioned adjacent said raised portion in a horizontal position when in said stationary position.

6. An apparatus for feeding record cards from a stack of cards into engagement with a blocking member comprising:

a. means for supporting a stack of cards;

b. a constantly rotating drive means rotating in a first direction;

c. a driven member positioned adjacent the lowermost card in said stack and engaging said drive means for rotation in a second direction opposite to said first direction;

d. a rotatably mounted lever member supporting said driven member for movement in said second direction into an engaged position with the lowermost card in the stack when rotated while engaged with said drive means, said driven member being rotated by said drive means in said second direction to feed the lowermost card into engagement with the blocking member;

e. and actuating means engaging said lever member to rotate said lever member for moving said driven member into its card engaging position when enabled, said drive means moving said rotating driven member in said first direction to a disengaged position upon the disabling of said actuating means, said rotating driven member constantly urging the lowermost card against the blocking member during movement of the driven member to the disengaged position.

7. The feeding apparatus of claim 6 further comprising:

a. a hopper for supporting said stack of cards including a horizontal supporting surface;

b. an aperture in said hopper adjacent one end of said supporting surface;

c. and said supporting surface having a raised portion located opposite said aperture for supporting the cards in an angular position whereby one end of the lowermost card is normally positioned adjacent the aperture for movement therethrough when engaged by said driven member, said lowermost card positioned adjacent said raised portion in a horizontal position when located against said blocking member.

8. The feeding apparatus of claim 7 in which said supporting surface extends adjacent said hopper and terminates in an edge portion for blocking the movement of the lowermost card from said hopper, said apparatus further includes feed means located within the extension of said supporting surface for feeding the lowermost card from engagement with the edge portion of said supporting surface in a direction perpendicular to the movement of the card into the edge portion.

9. The feeding apparatus of claim 6 in which said drive means includes a fixed position drive wheel and means for constantly rotating said drive wheel, said lever member being mounted for rotational movement about an axis axially aligned with the axis of rotation of said drive wheel while supporting said driven member in contact with said drive wheel for rotation thereby, said lever member being rotated in said second direction upon operation of said actuating means to move the rotating driven member in said second direction around the periphery of said drive wheel and into engagement with the lowermost card in said stack.

10. Apparatus for feeding cards from a stack of cards to a stationary position including:

a. an elongated horizontal supporting surface having a raised portion at one end and a blocking portion at the opposite end for supporting the stack of cards thereon, wherein the end of the stack of cards is positioned on said raised portion;

b. a slot located in said supporting surface adjacent said raised portion;

c. a constantly rotating drive wheel rotating in a first direction;

d. a lever member rotatably mounted on the axis of rotation of said drive wheel;

e. a feed wheel rotatably mounted on one end of said lever member and in engagement with said drive wheel for rotation thereby in a second direction opposite to said first direction, said feed wheel positioned adjacent said slot;

f. and an actuating member engaging the other end of said lever member to rock the lever member in said second direction to an actuated position when operated whereby said rotating feed wheel is rotated in said second direction by said lever member around the periphery of said drive wheel through said slot and into frictional engagement with the raised end of the lowermost card of the stack for feeding the engaged card along said supporting surface to a stationary position against said blocking portion, said rotating feed wheel being rotated in said first direction about the periphery of said drive wheel to a disengaged position by said drive wheel upon the disabling of said actuating member, said rotating feed wheel acting against the stationary lowermost card to continually urge the lowermost card towards the stationary position during movement of the feed wheel to the disengaged position.

11. A card feeding device comprising:

a. a hopper for receiving a stack of cards, said hopper having front and rear walls;

b. a first horizontal support member affixed at one end to said rear wall for supporting said stacked cards, said first support member extending past and being spaced below the rear wall to form a throat passage therewith;

c. abutment means located on said first support member adjacent the throat passage;
d. a slot in said first support member;
e. a feed wheel positioned adjacent the slot in said first support member;
f. a drive wheel positioned adjacent said feed wheel and rotating in a first direction;
g. a lever member rotatably mounted on the axis of said drive wheel and having one end supporting said feed wheel in engagement with said drive wheel for rotating said feed wheel in a second direction opposite to said first direction;
h. means engaging said stack of cards for urging the cards toward said feed wheel;
i. and an actuating member engaging the other end of said lever member for rotating said lever member, when operated, in said second direction to move the feed wheel from a card disengaged position through the slot in said first support member and into engagement with the lowermost card in the stack to feed the card through the throat passage and into engagement with said abutment means, said rotating feed wheel continuously urging the card into engagement with the abutment means while being moved in said first direction to its disengaged position by the rotation of the drive wheel upon the disabling of said actuating member.

12. The card feeding device of claim 11 in which said abutment means comprises a raised edge portion of said first support means for holding the card against the feed movement of said feed wheel is said second direction during movement of the feed wheel in said first direction to a disengaged position.

13. The card feeding device of claim 11 in which one end of said first support member comprises a raised edge for angularly positioning the end of the lowermost card in said stack adjacent the throat passage to allow the feed wheel to feed the lowermost card through the throat passage to a position against the abutment means, said lowermost card positioned adjacent said raised edge in a horizontal position when positioned against the abutment means, said card feeding device further including card feeding means positioned adjacent said abutment means for engaging and feeding said lowermost card from engagement with said abutment means.

* * * * *